US005358738A

United States Patent [19]

Sawka

[11] Patent Number: 5,358,738

[45] Date of Patent: Oct. 25, 1994

[54] METHOD AND APPARATUS FOR PAINTING THE SURFACES OF WOOD CHIPS

[76] Inventor: Craig S. Sawka, 7777 Ives, Grosse Ile, Mich. 48138

[21] Appl. No.: 40,885

[22] Filed: Mar. 31, 1993

[51] Int. Cl.[5] ..... B05D 7/00

[52] U.S. Cl. ..... 427/220; 427/372.2; 427/389.9

[58] Field of Search ..... 427/212, 372.2, 220, 427/389.9

[56] References Cited

U.S. PATENT DOCUMENTS 4,932,156 6/1990 Underwood ..... 47/9
5,192,587 3/1993 Rondy ..... 427/212

FOREIGN PATENT DOCUMENTS 617083 7/1978 U.S.S.R. .

OTHER PUBLICATIONS

The Becker-Underwood Company, "Mulch Producers Use of Mulch Colorants," Mar. 1991, pp. 1-6.

*Primary Examiner*—Shrive Beck
*Assistant Examiner*—David M. Maiorana
*Attorney, Agent, or Firm*—Harness, Dickey & Pierce

[57] ABSTRACT

The surfaces of masses of wood chips are painted to pre-selected colors by conveying the chips along an elongated path in an auger-type screw conveyor and, simultaneously, spraying predetermined amounts of a liquid colorant or paint, upon the mass of moving chips. The rotating screw is arranged within a U-shaped, in cross-section, trough. The conveyor is divided into a closed paint application zone, within which the paint is sprayed upon the moving mass of chips, and a following paint spreading and paint drying zone, in which the trough is open to the atmosphere to allow air circulation and evaporation to enhance the drying process of the paint. The paint is spread upon the surfaces of the chips by the autogenous action of the tumbling chips contacting and rubbing against each other as they are conveyed along the path from the feed end of the screw to the discharge end thereof. The paint is sprayed into the mass of chips at separated locations along the length of the first zone and the total amount of paint applied is correlated to the amount needed for covering the surfaces of the wood chips without substantially soaking beneath the surfaces of the chips to avoid saturating the chips.

4 Claims, 1 Drawing Sheet

METHOD AND APPARATUS FOR PAINTING THE SURFACES OF WOOD CHIPS

BACKGROUND OF INVENTION

Small pieces of wood, such as wood chips or wood particles formed by chopping or cutting scrap lumber or trees, are frequently used as a ground cover or mulch in gardens or groomed outdoor areas. The application of a relatively thick coating of wood chips or particles which are generically referred to as "wood chips," upon the surface of the ground tend to retain the moisture within the ground, limits the growth of unwanted plants, such as weeds, and provides clear surfaces upon walking paths, in addition to providing a decorative effect in pre-selected areas.

However, wood chips generally have a dull or unattractive color. For example, they commonly become a grayish color which is visually unattractive. Moreover, unprotected wood chips generally tend to rot quickly, particularly in moist areas so that frequent additions of wood chips in such areas are required. Consequently, it is common to treat wood chips, which are to be used as ground cover or mulch, with a colorant or paint which imparts a more attractive color to a bed of wood chips and which resists rotting of the wood chips.

A known way of coloring or painting wood chips is by applying a liquid colorant upon wood chips conveyed within an auger-screw type of conveyor. Such type conveyors, which generally comprise an elongated screw contained within a trough-like housing, have been commonly used in industry and on farms for moving particulate materials along horizontal or upwardly angled paths. The paint or colorant is applied by immersing the wood chips in a pool of liquid colorant or paint at the entry end of an auger screw conveyor or by spraying the colorant upon the chips as they move along the conveyor. The immersion technique substantially saturates the chips with paint. Similarly, the spray technique tends to saturate the chips to a substantial depth. In either technique, excess paint clinging to the chips runs downwardly along the housing that surrounds the screw back into the pool of colorant or to some other drain for collection and possible re-use. When the colorant is applied at the entry of the conveyor the paint is dried to a considerable extent as the chips ave moved along the conveyor until their discharge from the conveyor. Typically the chips fall by gravity downwardly into a pile in which the chips continue drying. In the case of spray application of a colorant, the wet paint may be dried after discharge from the auger conveyor.

In painting or coloring wood chips, a considerable amount of the liquid colorant or paint is absorbed by the chips so that the chips tend to be saturated with colorant or paint. Consequently, a considerably greater amount of paint or colorant is normally used than is really necessary for the purposes of coloring the visually exposed surfaces of the chips or for preserving the chips. Since suitable colorants or paints are relatively expensive, the expense of preparing colored wood chips is considerable. This reduces the desirability of using colored wood chips for mulch purposes.

Thus, it is an object of the present invention to provide a method and apparatus which applies paint to the surfaces of wood chips, that is, small pieces of wood formed by chipping, chopping, cutting, grinding or the like, without thoroughly soaking and without saturating the chips so as to substantially reduce the amount of colorant or paint required and, consequently, to reduce the expense of such colored chips.

SUMMARY OF INVENTION

This invention contemplates continuously conveying masses of wood chips along a lengthy path formed by a rotating, elongated, auger screw arranged within a trough-like housing. Approximately the first half of the length of the housing is covered and forms a paint application zone. The second half of the housing is open to the atmosphere and forms a paint spreading and drying zone. A paint distribution tube extends over the paint application zone and has suitable nozzles at spaced apart locations for spraying paint upon the mass of chips passing beneath them. a suitable water-based colorant or paint is spread upon the surfaces of the chips by a combination of the direct spray from the nozzles and by the autogenous action of the chips. That is, the chips contact and rub against each other while being tumbled and moved by the screw. That action tends to wipe or spread the paint over the exposed surfaces of the chips. The amount of colorant or paint sprayed is correlated to the amount needed to cover the surfaces of the chips without saturating the chips or substantially soaking them below their exposed surfaces. The total amount of colorant is divided into smaller parts applied which is applied by the spray nozzles at spaced apart locations along the auger.

Preferably, the auger and its housing are arranged at an upwardly extending angle, from their entry towards their discharge ends. The discharge end is sufficiently high above the ground to permit the chips to fall by gravity into a pile beneath the discharge end of the conveyer outlet. Then, the chips may be removed from the pile as needed.

As mentioned, the liquid colorant or paint which is sprayed upon the mass of chips in the first zone of the auger screw conveyor is spread upon the surfaces of the chips by both the direct spray and by the tumbling contacts of the chips. That autogenous spreading action continues as the chips move through the second zone of the auger screw. But, simultaneously, because housing is open over the second zone to the atmosphere, the water carrier of the colorant evaporates so that the paint drys to a substantial degree while the chips are tumbled before they are discharged from the conveyor.

The basic object of the present invention is to substantially reduce the amount of liquid colorant or paint that is needed to properly color the wood chips for both aesthetic purposes as well as for preservation of the chips. This is accomplished by avoiding saturating or thoroughly soaking the wood chips by gradually applying the paint at spaced apart locations in the first zone of the path of movement of the chips and spreading the paint by rubbing together adjacent surfaces of the wood chips and continuing the rubbing action as the paint drys. This prevents the paint from soaking into the interior of the wood chips and saturating the chips.

A further object of this invention is to provide an inexpensive and simple technique for painting the exterior, highly irregular, surfaces of wood chips which may be formed in a variety of ways and which are relatively small size, without wasting paint or using unnecessarily large quantities of paint or colorant for the intended purpose.

Still a further object of this invention is to provide an apparatus which, essentially, is the same as a common auger-type conveyor used on farms for the conveyance of feed or other natural materials or used in industrial plants for conveying particulate substances. Such conveyors have been used in a variety of locations and, therefore, are well developed, generally trouble-free in operation and are commercially available. Thus, the equipment needed is relatively inexpensive and easy to operate with unskilled labor.

These and other objects and advantages of this invention will become apparent upon reading the following description, of which the attached drawings form a part.

DETAILED DESCRIPTION

Figure 1:
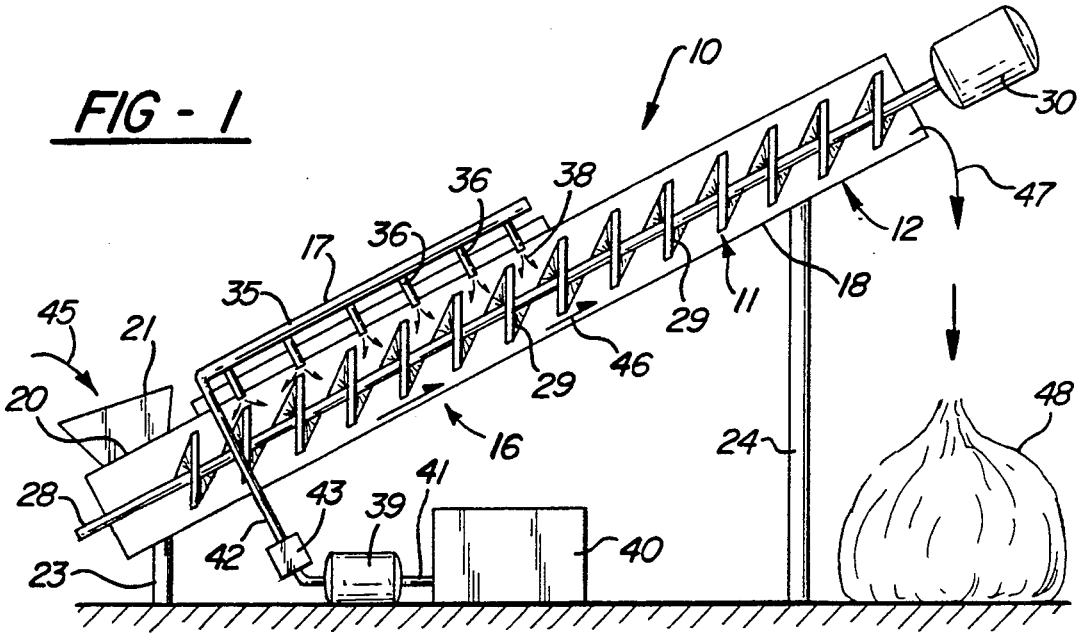
FIG. 1 is a schematic view of the apparatus and method of operation of the apparatus.
Figure 2:
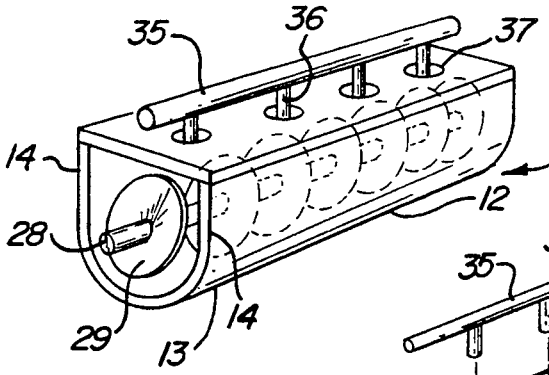
FIG. 2 is a schematic, fragmentary, perspective view of a portion of the paint application zone of the conveyor and paint supply tube and nozzles.
Figure 3:
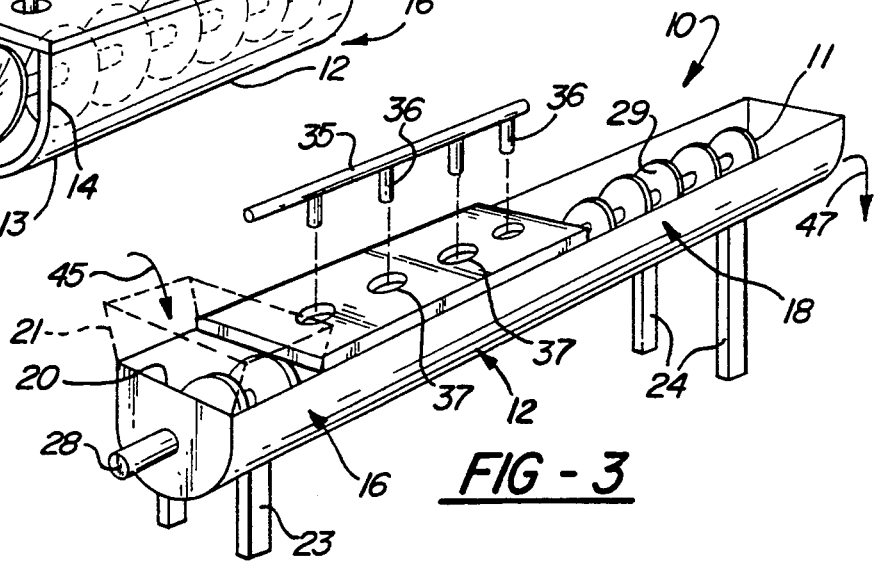
FIG. 3 is an enlarged, schematic, perspective view of the conveyor with the paint supply tube and nozzles separated.
Figure 4:
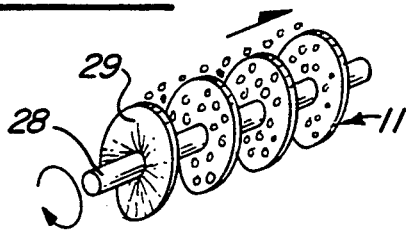
FIG. 4 is a perspective, schematic view, of a section of the screw conveyor schematically showing the movement of a mass of wood chips

Referring to the drawings, the paint applying apparatus includes an auger screw-type conveyor 10, which is illustrated schematically in FIG. 1. The auger screw 11 preferably is of considerable length, such as on the order of thirty feet, more or less, and about one to two feet in diameter. It is contained within a surrounding housing 12 which is generally U-shaped in cross-section configuration to form an upwardly open trough. The trough may be formed with a circularly curved base 13 with upwardly extending walls 14 which provide the legs of the U-shaped trough.

The conveyor is divided into two zones, namely, a paint application zone 16 which extends a substantial portion of the length of the conveyor. For example, the paint application zone may extend about half way or roughly 60% of the distance from the conveyor inlet end towards the conveyor discharge end. The paint application zone is provided with a cover 17 over the upper portion of the trough.

A second zone 18 forms a paint spreading and drying zone. This zone is preferably uncovered so that the liquid carrier, e.g., the water, of the colorant or paint may evaporate into the atmosphere due to the open-air circulation through the conveyor housing. An opening 20 is provided at the inlet end of the conveyor housing 12 and a hopper or rim construction 21 may be provided at the opening. Thus, a mass of wood chips may be dumped into the opening, through the hopper rim, either manually, such as by shoveling the mass into the opening, or by a suitable conveyor which can carry masses of chips into the opening.

Preferably, the conveyor housing with the auger screw are arranged at an upwardly inclined angle relative to the ground. For that purpose, front legs 23 support the inlet end of the conveyor housing and considerably longer, rear legs 24 support the housing at its discharge end 25. The supporting structure is shown schematically. By elevating the discharge end, the conveyed mass of chips can be dropped into a pile located beneath the discharge end for removal by suitable equipment, such as another conveyor or a front-end loader, or manually in wheelbarrows, as the case may be.

The auger screw 11 is formed conventionally with a shaft 28 and a surrounding helical thread 29. The shaft is rotated by a motor 30 which may be either an electrically operated motor or a conventional hydraulically operated motor. Either type of motor is commercially available and are commonly used with auger-screw conveyors. Thus, the motor is shown schematically. The motor may be mounted at the upper end of the screw (see FIG. 1) or the lower end, as is conventional.

A paint feed tube 35 is arranged above the cover 17 of the paint application zone. The tube may be provided with spray nozzles 36 of conventional construction. These nozzles extend through openings 37 in the cover and when operated, spray a liquid colorant or paint downwardly into the mass of wood chips that are moved along the auger. Arrows 38 indicate the spraying of the paint or colorant (see FIG. 1).

The paint feed tube 35 may be fastened upon the upper surface of the cover 17 or may be otherwise mounted upon the housing, such as beneath the cover or along the upper portion of the interior of one of the walls defining the trough. Thus, the tube is shown schematically as located above and upon the cover with its nozzles extending through the openings 37 in the cover for spraying the paint downwardly against the mass of wood chips.

A conventional pump 39 draws the liquid colorant or paint from a large mixing tank 40 through a pipe 41. The pump forces the paint, which may be a mixture of water with a commercially sold colorant material, through a hose 42 which extends to the tube 35. The pressure generated by the pump forces the paint through the tube and out through the tube nozzles 36. The pump is regulated to supply the paint at a pre-determined rate and volume which is correlated to the amount of paint needed to cover the surfaces of the wood chips without saturating or soaking deeply into the wood chips. For that purpose a pump volume and pressure regulator 43 is schematically shown in the line. Suitable volume and pressure regulators for controlling the flow of liquid are commercially available for this purpose. The particular volume and pressure selected can be determined by trial and error and depends upon the viscosity of the paint, the type of nozzles, the volume of chips, etc.

In operation, a mass of wood chips, schematically indicated by the arrow 45 in FIG. 1 is dumped into the opening 20 at the inlet end of the conveyor. These chips may be formed of small pieces of wood, such as scrap lumber or pieces of natural tree limbs or tree trunks or saw mill waste, etc. The sizes and shapes of the wood chips will vary considerably and the sizes may be regulated to particular size ranges desirable for any particular mulch or ground covering. By way of example, a mass of wood chips may range from one-quarter through two inches in maximum length or width dimensions. Larger or smaller chips may be used and the range of sizes in the mass of chips may vary. For purposes of description, the term "wood chips" is used to designate particles or pieces of wood regardless as to how made.

The mass of wood chips moves through the conveyor by the action of the auger screw and as the chips move, they are tumbled relative to each other and constantly contact and rub against each other. Thus, the mass of chips, indicated by the arrow 46 travels generally upwardly with a tumbling action, towards the discharge end of the conveyor. The angling of the screw causes the chips between each pair of screw threads to press downwardly towards the next lower thread that assists in causing the chips to tumble and rub against each other. At the discharge end, the chips fall out and downwardly, as indicated by the arrow 47, into a pile 41B located beneath the discharge end of the conveyor.

Figure 5:
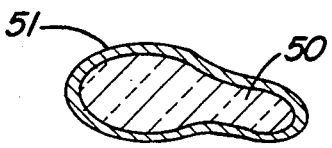
FIG. 5 is a schematic, enlarged, cross-sectional view of a wood chip with a painted surface.

A single wood chip is schematically shown in FIG. 5. The wood chip 50 is essentially coated or painted with a surface coating 51. The surface coating, when the quantity of applied paint is suitably correlated to the volume and mass of the chips, remains upon the surface, without deeply soaking into or saturating the chip.

Suitable paint or colorant is commercially available and therefore is not described in detail. For disclosure purposes, the colorant typically is formed of a coloring material carried by a liquid carrier such as water, which evaporates to leave the paint film on the wood surfaces. The colorant may be mixed with water in the mixing and holding tank 40, or per-mixed. The liquid colorant is then drawn from the tank, by the pump 39, through the volume and pressure regulator 43 and pumped though the line 42 to the paint applying tube 35. Then, the liquid colorant is sprayed through the spaced-apart nozzles 36 upon the tumbling and moving mass of wood chips, indicated by the arrow 46. The colorant or paint is spread upon the surfaces of the wood chips first, by the downwardly directed spray and then by the smearing of the paint caused by the rubbing or contacting of the chips with each other as they tumble and move along the auger screw.

The liquid colorant or paint is sprayed in sufficient quantity at each of the spray nozzles to spread upon the adjacent chips without excess paint, i.e. more paint than is needed for covering the surfaces of the chips at that location. Therefore, by the time the chips complete their travel through the paint application zone, they are substantially coated without excess paint running off the chips and without deeply soaking or saturating the chips. Thereafter, as the chips travel through the spreading and drying zone, the paint is autogenously spread and its liquid carrier evaporates so that by the time the chips reach the discharge end of the conveyor they are well coated with the paint and the paint is sufficiently dry for handling the chips further. If the chips remain somewhat wet, the falling of the chips through the air into the pile beneath the discharge end of the conveyor, as well as the piling of the chips in the pile beneath the conveyor, enables the evaporation of the liquid carrier to continue for complete drying of the painted surfaces.

This invention may be further developed within the scope of the following claims. Accordingly, having fully described an operative embodiment of this invention, I now claim:

1. A method for autogenously painting the surfaces of wood chips with a liquid colorant including:

conveying a mass of wood chips along a path from an entry point to a discharge point and continuously tumbling the chips as they are conveyed along the path so that adjacent chips continuously contact against numerous other adjacent chips as the chips are conveyed;

applying an amount of liquid colorant upon the tumbling mass of chips at a number of separated places along about the first half of the path, as the mass of chips are conveyed;

correlating the total amount of liquid colorant applied at all of the places along the conveyor path to the amount needed to paint the surfaces of the chips without soaking into the chips so as to avoid saturating the chips with the liquid colorant;

autogenously spreading the liquid colorant upon and, thereby, painting the surfaces of the chips with the liquid colorant by the contacting actions of adjacent chips;

and continuing spreading the liquid colorant upon the surfaces of the chips and simultaneously drying the painted surfaces of the chips as the chips are conveyed along the second half of the path to the discharge point and the dry chips are substantially dry to enable handling as the chips exit the path.

2. A method as defined in claim 1, and simultaneously elevating the chips as they are conveyed along said path;

and discharging the chips by gravity from the discharge point of the path so that the chips form a pile of chips having painted surfaces beneath the discharge point.

3. A method as defined in claim 1, and spraying said liquid colorant in a downwardly direction upon the adjacent portion of the mass of chips conveyed beneath the respective separated places along the conveyor path, so that the colorant spreads upon the surfaces of the chips partially, by the spraying, and partially by the rubbing contacts between the surfaces of adjacent chips.

4. A method as defined in claim 3, and including conveying and tumbling said chips by an elongated, auger screw which is continuously rotated to carry the chips from the entry point to the discharge of said path;

and spraying the colorant only along the portion of the screw extending from near the entry point to about half way towards the discharge point and opening to the atmosphere for the remaining portion of the auger screw, that is, from the end of the spraying to the discharge point for continuing the autogenous spreading of the colorant on the surfaces of the wood chips while simultaneously drying the colorant while the chips are conveyed to the discharge point.

* * * * *